US009601257B2

(12) United States Patent
Burke et al.

(10) Patent No.: US 9,601,257 B2
(45) Date of Patent: Mar. 21, 2017

(54) WIND-ON CORE MANUFACTURING METHOD FOR SPLIT CORE CONFIGURATIONS

(75) Inventors: Frank P. Burke, Waterford (IE); Ryan M. Parrish, Columbia, MO (US)

(73) Assignee: ABB Schweiz AG, Baden (CH)

( * ) Notice: Subject to any disclaimer, the term of this patent is extended or adjusted under 35 U.S.C. 154(b) by 928 days.

(21) Appl. No.: 13/295,199

(22) Filed: Nov. 14, 2011

(65) Prior Publication Data

US 2013/0118002 A1 May 16, 2013

(51) Int. Cl.
*H01F 41/02* (2006.01)
*H01F 27/24* (2006.01)
(Continued)

(52) U.S. Cl.
CPC ..... *H01F 27/26* (2013.01); *H01F 1/153* (2013.01); *H01F 3/02* (2013.01); *H01F 3/04* (2013.01); *H01F 27/24* (2013.01); *H01F 27/2455* (2013.01); *H01F 41/00* (2013.01); *H01F 41/02* (2013.01); *H01F 41/0206* (2013.01);
(Continued)

(58) Field of Classification Search
CPC ..... H01F 41/00; H01F 41/02; H01F 41/0206; H01F 41/0213; H01F 41/0226; H01F 41/06; H01F 41/0616; H01F 1/153; H01F 27/24; H01F 27/2455; H01F 3/02; H01F 3/04; H01F 2007/083; H01F 41/061; H01F 27/26; H01F 41/0233; Y10T 29/49075; Y10T 29/49078; Y10T 29/49071
USPC ..... 29/602.1, 606, 607, 609; 336/213, 219, 336/234
See application file for complete search history.

(56) References Cited

U.S. PATENT DOCUMENTS 3,251,208 A * 5/1966 Mittermaier ..... H01F 27/2455
6,411,188 B1 * 6/2002 Pruess et al. ..... 29/602.1 X
(Continued)

FOREIGN PATENT DOCUMENTS

GB 1050309 A 12/1966
JP 60041210 A 3/1985
(Continued)

OTHER PUBLICATIONS

PCT Search Report & Written Opinion in PCT/US2012/062035 dated Feb. 7, 2013.

*Primary Examiner* — A. Dexter Tugbang
(74) *Attorney, Agent, or Firm* — Manelli Selter PLLC; Edward J. Stemberger

(57) ABSTRACT

A method provides a portion of a transformer by forming a core by providing transformer core material, cutting individual laminations and bending them into generally C-shaped members, stacking some members to define a first core portion having a main leg and two opposing end legs, stacking other members to define a second core portion having a main leg and two opposing end legs, arranging the main legs in a back-to-back manner to define the core having a core leg defined by the two main legs, and opposing core yokes, defined by the end legs. Conductive material is wound directly around the core leg to form a primary winding and secondary winding in any order of arrangement, thus providing a first transformer portion. The transformer portion may be part of a single transformer or, when second and third transformer portions are provided, as part of a three-phase transformer.

18 Claims, 4 Drawing Sheets

(51) Int. Cl.

| | |
|---|---|
| ***H01F 27/26*** | (2006.01) |
| ***H01F 41/00*** | (2006.01) |
| ***H01F 27/245*** | (2006.01) |
| ***H01F 1/153*** | (2006.01) |
| ***H01F 41/06*** | (2016.01) |
| ***H01F 3/04*** | (2006.01) |
| ***H01F 3/02*** | (2006.01) |
| *H01F 7/08* | (2006.01) |

(52) U.S. Cl.

CPC ..... *H01F 41/0213* (2013.01); *H01F 41/0226* (2013.01); *H01F 41/0233* (2013.01); *H01F 41/06* (2013.01); *H01F 41/061* (2016.01); *H01F 2007/083* (2013.01); *Y10T 29/49071* (2015.01); *Y10T 29/49075* (2015.01); *Y10T 29/49078* (2015.01)

(56) References Cited

U.S. PATENT DOCUMENTS 6,668,444 B2 * 12/2003 Ngo et al. ..... 29/602.1 X
7,057,489 B2 * 6/2006 Nathasingh et al. ..... 336/234

FOREIGN PATENT DOCUMENTS

JP 06061070 A * 3/1994
WO 9909567 A1 2/1999
WO 03107364 A1 12/2003

* cited by examiner

WIND-ON CORE MANUFACTURING METHOD FOR SPLIT CORE CONFIGURATIONS

FIELD

The invention relates to power distribution transformers and, more particularly, to method of manufacturing a split core configuration with primary and secondary windings wound directly thereon.

BACKGROUND

Conventionally, the core manufacturing process and the coil manufacturing process for distribution transformers are separate, with the cores and coils being assembled at a later stage. To facilitate this, the cores and coils are produced to a set of standard sizes to simplify manufacturing and to reduce the amount of core tooling required. As a result of this standardization, it is not possible to optimize both the core and coil configurations fully. This leads to increased cost and loss of competitiveness.

Thus, there is a need to provide fully flexible core configurations at similar output speeds to existing wound core technology.

SUMMARY

An object of the invention is to fulfill the need referred to above. In accordance with the principles of an embodiment, this objective is achieved by a method of providing a portion of a transformer. The method forms a core of the transformer by providing transformer core material, cutting individual laminations and bending them into generally C-shaped members, stacking certain of the members to define a first core portion having a main leg and two opposing end legs, stacking other of the members to define a second core portion having a main leg and two opposing end legs, and arranging the main legs in a back-to-back manner to define the core having a core leg defined by the two main legs, and opposing core yokes defined by the end legs. Conductive material is wound directly around the core leg to form a primary winding and secondary winding in any order of arrangement, thus providing a first transformer portion. The first transformer portion may be part of a single transformer or, when second and third transformer portions are provided, as part of a three-phase transformer.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings wherein like numbers indicate like parts, in which.

DETAILED DESCRIPTION OF THE EXEMPLARY EMBODIMENTS

The embodiment relates to a manufacturing method for single and three-phase core and shell type distribution transformers. Thus, with reference to FIG. 1, there is shown a perspective view of a portion of a single phase transformer, generally indicated at 10, containing a core configuration, generally indicated at 12, embodied in accordance with the present invention. The core 12 is comprised of two core portions 16 and 18, as explained below. The transformer portion 10 comprises a winding assembly 14 mounted to the core 12.

Figure 2:
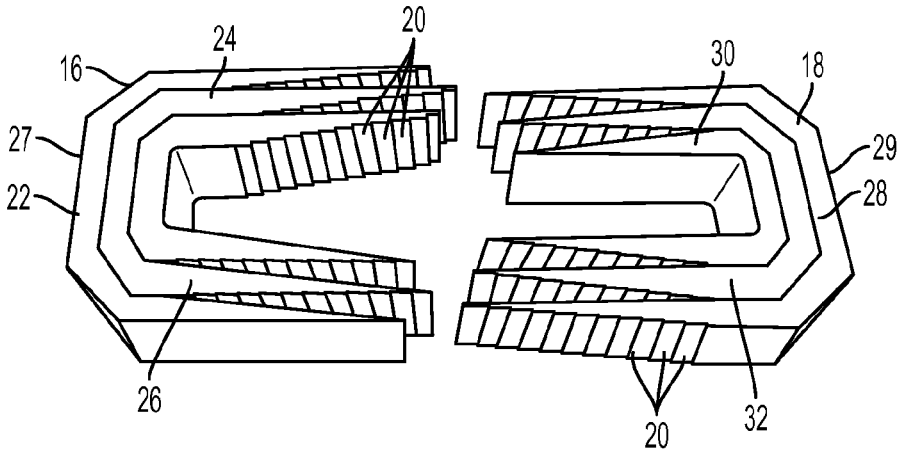
FIG. 2 is a view of core portions of the transformer portion of FIG. 1.

With reference to FIG. 2, to form each core portion 16 and 18, first, transformer core material such as a sheet of ferromagnetic metal is provided. Individual laminations 20 are cut from the core material. Each lamination 20 is bent into a generally C-shape and certain of these laminations 20 are stacked to define the first core portion 16 having a main leg 22 and two opposing end legs 24, 26. The main leg 22 has a back surface 27. Other laminations 20 are stacked to define the second core portion 18 having a main leg 28 and two opposing end legs 30, 32. The main leg 28 has a back surface 29.

Figure 3:
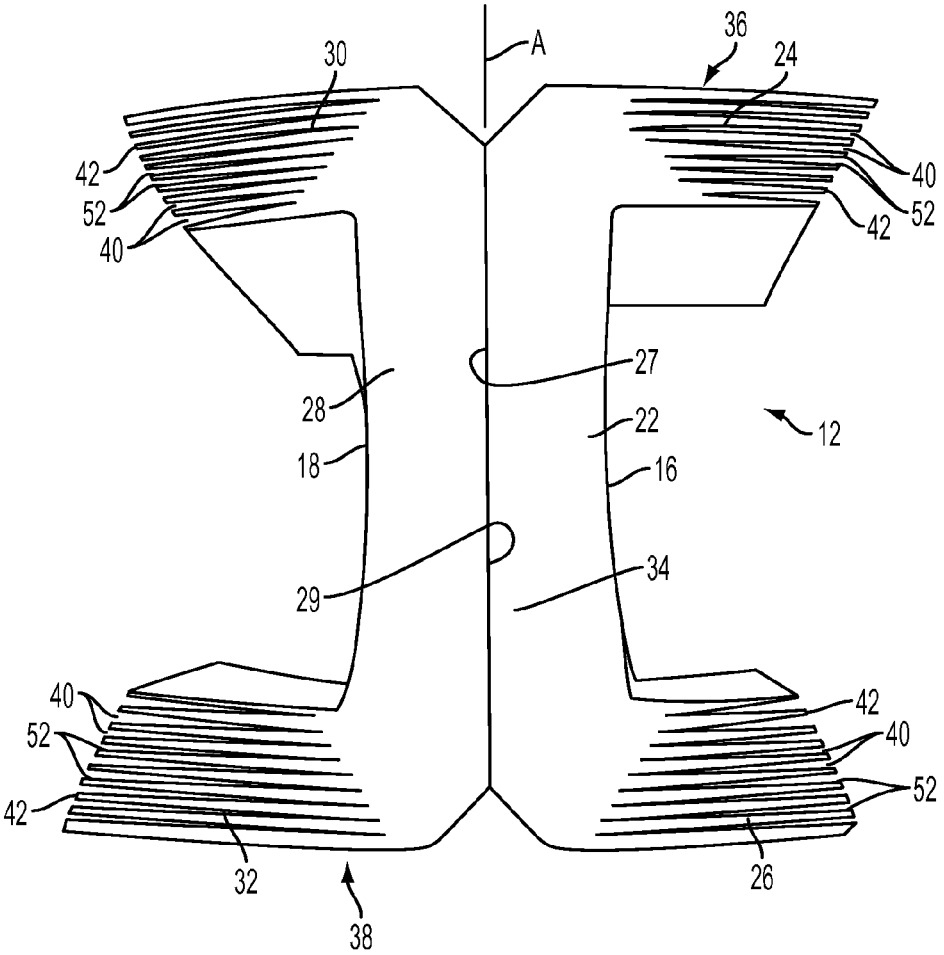
FIG. 3 is a view of a core of the transformer portion of FIG. 1.

Referring to FIG. 3, the back surfaces 27 and 29 of the respective main legs 22 and 28 are arranged to contact in a back-to-back manner to define the core 12 having a core leg 34 defined by the two main legs 22, 28, and opposing core yokes, generally indicated at 36 and 38, with yoke 36 defined by end legs 24 and 30 and yoke 38 defined by the end legs 26 and 32. The back surfaces 27 and 29 may be coupled or joined. The core 12 is preferably formed on a conventional Unicore producing machine manufactured by AEM Unicore by modifying the programming thereof, or by a machine specifically configured for forming the core 12.

Figure 1:
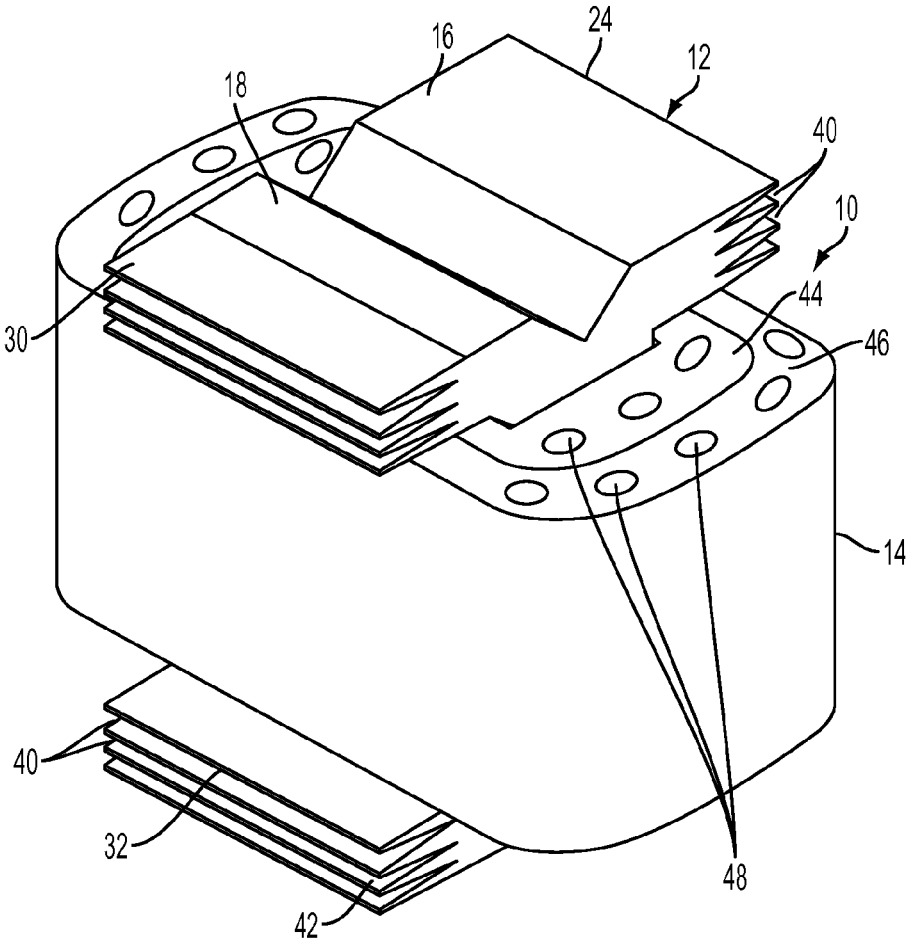
FIG. 1 is a view of a portion of a transformer provided in accordance with an embodiment.

After the core 12 is formed the core 12 is moved to a winding machine and conductive material such as copper is wound directly about the core leg 34 to define the winding assembly 14 (FIG. 1). In particular, the winding assembly 14 includes a low voltage winding 44 and a high voltage winding 46. Two separate machines can be used to wind the low voltage winding 44 and the high voltage winding 46. Alternatively, a single, combination machine can be used to wind both windings 44, 46.

As best shown in FIGS. 1 and 3, slits 40 are provided in the ends 42 the yokes 36 and 38 to facilitate direct winding of the core 12 to form a transformer as will be described below. The slits 40 define alternating cuts and protrusions 52 (FIG. 3) that extend in a direction transverse with respect to an axis A of the core leg 34. Thus, moving the slits 40 to the yokes allows winding directly on the core leg 34. If the slits 40 are in the conventional position, such winding is not possible.

Figure 4:
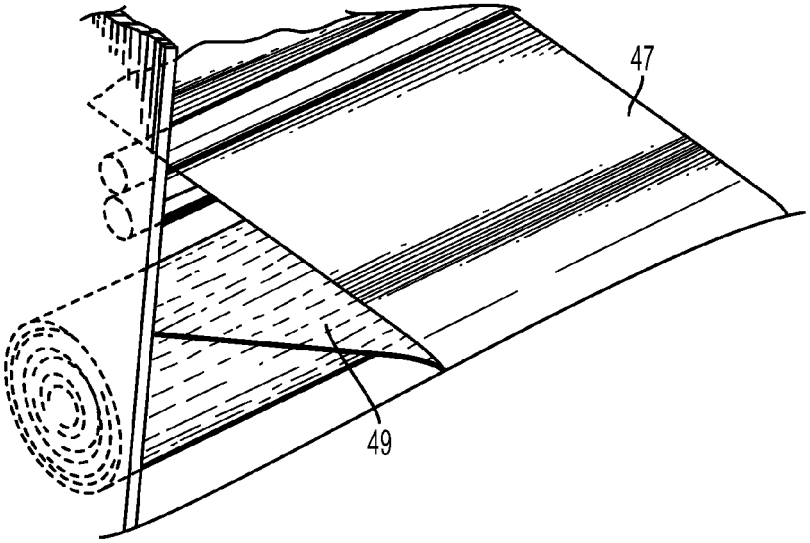
FIG. 4 is a view of conductive sheet being wound together with an insulating sheet in accordance with an embodiment.

An example of winding the low voltage winding 44 on a machine is as follows:

1) adjust core clamping tool to accommodate correct size of core 12 so that the main legs 22 and 28 are clamped in a contacting back-to-back manner,
2) mount the core 12 to winding machine,
3) select and load the correct conductive material and insulation material,
4) program the machine with number of turns/layers for particular core low voltage winding configuration,
5) start process by attaching a first busbar,
6) commence winding by winding conductive material 47 and insulation material 49 (FIG. 4) simultaneously (as disclosed in U.S. Pat. No. 6,221,297, the content of which is hereby incorporated by reference into this specification),
7) throughout the winding process insert cooling ducts 48 (FIG. 1) and insulation barriers as required,
8) at appropriate program position, attach the second busbar,
9) finalize the low voltage winding 44 and secure it with tape, and
10) remove the core 12 with low voltage winding 44 from the machine (if separate winding machines are use).

If two winding machines are used, the core 12 with low voltage winding 44 is then moved to a high voltage winding machine and the winding of the high voltage winding 46 is as follows:

1) adjust the core clamping tool to accommodate correct size core 12
2) mount core 12 (now with low voltage winding 44) to the machine,
3) select and load correct conductor material and insulation,
4) program the machine with the number of turns/layers for particular design,
5) commence winding (conductive material and insulation material simultaneously as above) over the low voltage winding 44,
6) throughout the winding process insert cooling ducts and insulation barriers as required,
7) at appropriate program position, create electrical tapping points as required,
8) finalize the low voltage winding 46 and secure it with tape,
9) remove the core 12 with windings 44, 46 from the machine.

In the embodiment, it is noted that the high voltage winding 46 is wound upon the low voltage winding 44. However the order of winding and number of windings is not critical so long as at least a primary and secondary winding are formed. If the transformer is a step-down transformer, the high voltage winding 46 is the primary winding and the low voltage winding 44 is the secondary winding. Alternately, if the transformer is a step-up transformer, the high voltage winding 46 is the secondary coil and the low voltage winding 44 is the primary winding.

Figure 5:
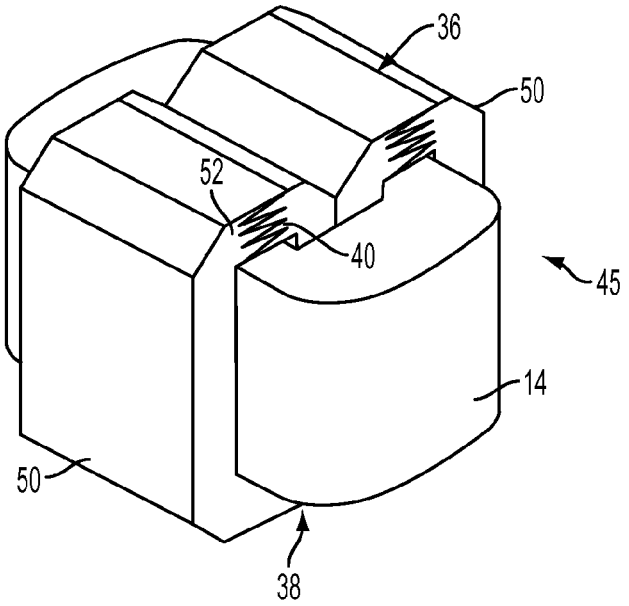
FIG. 5 is a view of a single phase transformer of an embodiment.
Figure 6:
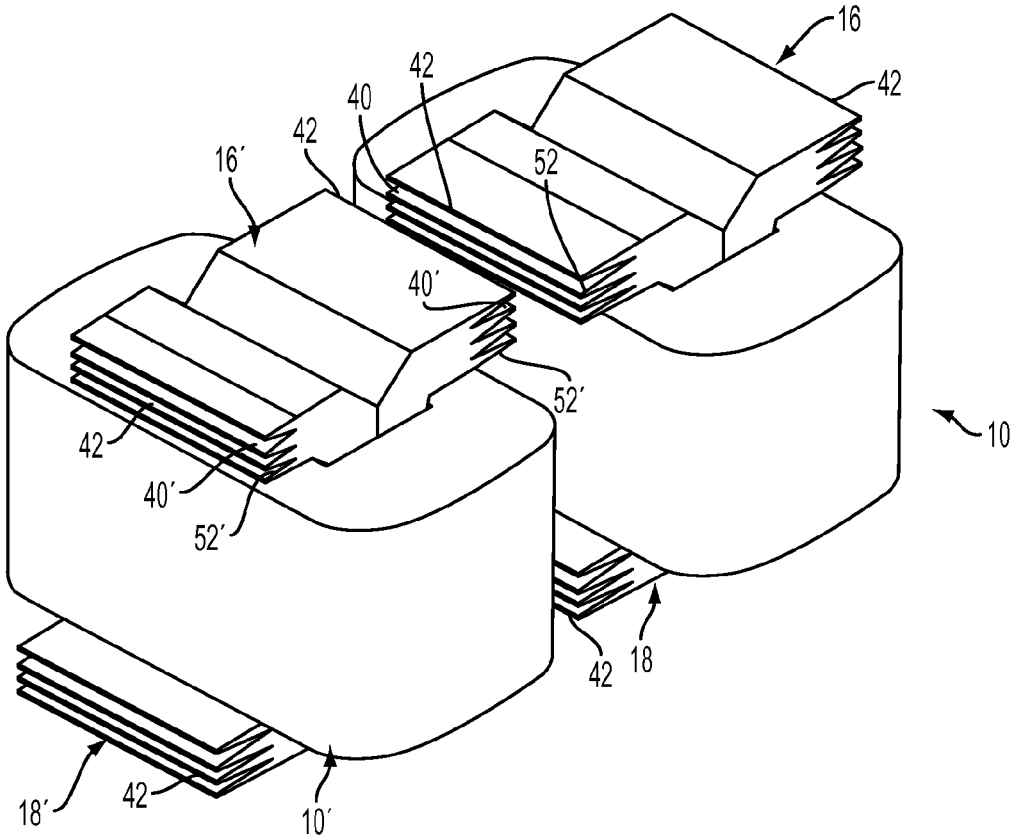
FIG. 6 is a view of one transformer portion being coupled to another transformer portion in accordance with an embodiment of providing a three-phase transformer.
Figure 7:
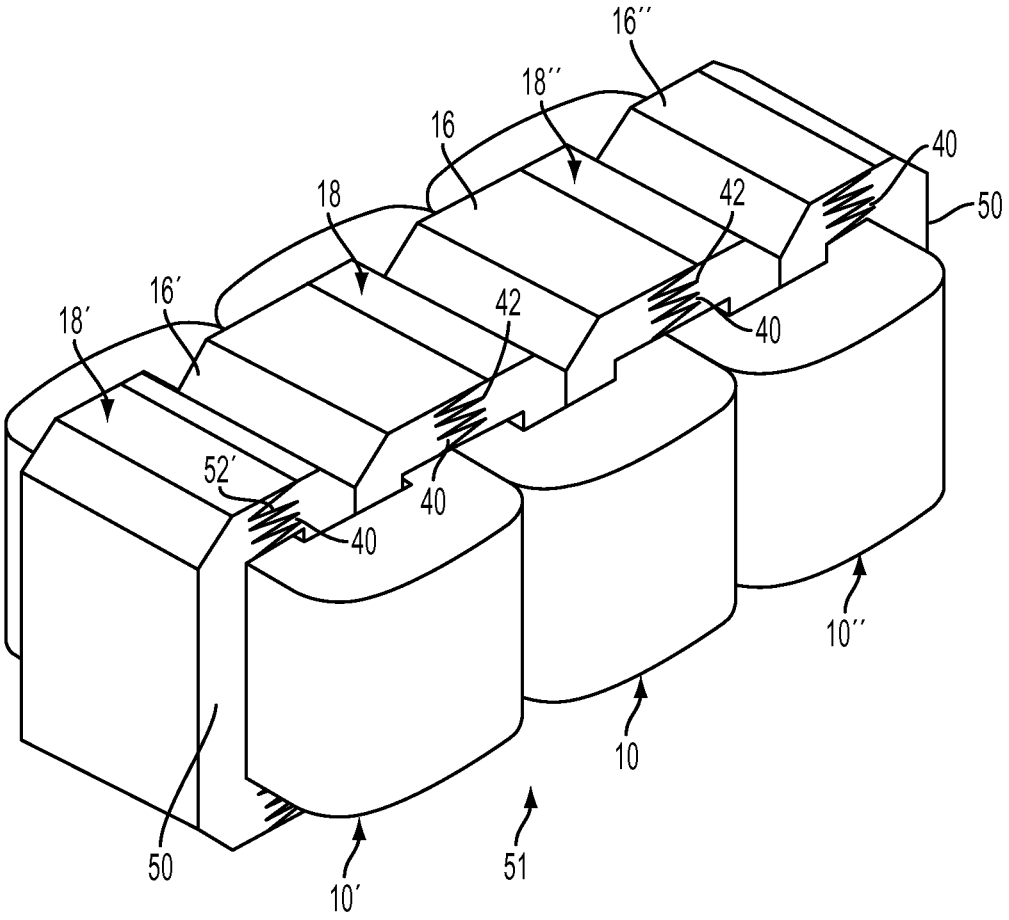
FIG. 7 is a view of a three-phase transformer of an embodiment.

With reference FIG. 5, to complete a single phase transformer, generally indicated at 45, C-shaped side legs 50 (see FIG. 6) are coupled to the yokes 36, 38 using the slits 40 and protrusions 52 defined in the ends thereof that cooperate with the slits 40 and protrusions of the end legs of the yokes 36, 38. The assembly of the side legs 50 is best explained with reference to FIGS. 6 and 7, where a three-phase transformer, generally indicated at 51, is formed. With reference to FIG. 6, three transformer portions are formed by the method described above. Two transformer portions 10 and 10' are shown FIG. 6, ready to be coupled together. Thus, transformer portion 10' is moved so that protrusions 52' in the end legs of the core portion 16' engage slits 40 in the end legs of the core portion 18 of the transformer portion 10, and protrusions 52 of the end legs of the core portion 18 of the transformer portion 10 engage slits 40' in the end legs of the core portion 16' of the transformer portion 10'. As shown in FIG. 7, a third transformer portion 10" is coupled to end legs of the core portion 16 of the transformer portion 10 in the same manner. Finally, a C-shaped side leg 50, also having the slits 40 and protrusions 52, is coupled to core portion 18' of the transformer portion 10' and to core portion 16" of the transformer portion 10" using the slits and associated protrusions thereof.

With the method of the embodiment, the windings 44 and 46 are wound directly onto the core leg 34 after manufacturing of the core 12 to reduce manufacturing time. The method also allows complete optimization of the core 12 and winding configuration to reduce material cost. It is also possible to eliminate the core annealing process using this method of core manufacture. The method further significantly improves manufacturing throughput, reduces labor, improves quality, and reduces OHS risks. The method allows wind-on core (WOC) leg for transformers traditionally manufactured using wound core technology.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A method of providing a portion of a transformer comprising:

forming a core of the transformer by:

providing transformer core material, cutting individual laminations from a single sheet of material, bending each individual lamination, one individual lamination at a time, into a generally C-shaped member, after the bending, stacking certain of the members to define a first core portion having a main leg and two opposing end legs, after the bending, stacking other of the members to define a second core portion having a main leg and two opposing end legs, arranging the main legs of the first and second core portions in a back-to-back manner to define the core having a core leg defined by the two main legs, and opposing core yokes, defined by the opposing end legs of the first and second core portions thereby eliminating a core annealing process in forming the core, and winding conductive material directly around the core leg to form a primary winding and secondary winding in any order of arrangement, thus providing a first transformer portion.

2. The method of claim 1, wherein the step of providing transformer core material provides a sheet of ferromagnetic metal.

3. The method of claim 1, wherein, prior to the step of winding the low voltage winding, the method includes clamping the main legs to be in contacting, back-to-back relation.

4. The method of claim 1, wherein during the step of winding the low voltage winding, cooling ducts are provided in the low voltage winding.

5. The method of claim 1, wherein during the step of winding the high voltage winding, cooling ducts are provided in the high voltage winding.

6. The method of claim 1, wherein the step of winding the conductive material to define the primary winding and the secondary winding includes winding the conductive material simultaneously with insulation material.

7. The method of claim 1, further comprising:

providing a pair of generally C-shaped side legs, coupling one side leg of the pair of C-shaped side legs to the end legs of the first core portion, and coupling the other side leg of the pair of C-shaped side legs to the end legs of the second core portion thereby defining a single phase transformer.

8. The method of claim 7, wherein the coupling steps further include engaging protrusions in the pair of C-shaped side legs with slits in the end legs of each of the first and second core portions, and engaging protrusions in the end legs of each of the first and second core portions with slits in the pair of C-shaped side legs.

9. The method of claim 1, further comprising:

providing second and third transformer portions, each having a first core portion, a second core portion, and two opposing end legs;

coupling the end legs of the first core portion of the second transformer portion to the end legs of the second core portion of the first transformer portion, coupling the end legs of the second core portion of the third transformer portion to the end legs of the first core portion of the first transformer portion, coupling a first C-shaped side leg to the end legs of the second core portion of the second transformer portion, and coupling a second C-shaped side leg to the end legs of the first core portion of the third transformer portion to define a three-phase transformer.

10. The method of claim 9, further including engaging protrusions in the end legs of the first transformer portion with slits in the associated end legs of each of the second and third transformer portions, and engaging protrusions in the end legs of each of the second and third transformer portions with associated slits in the end legs of the first transformer portion, and wherein the steps of coupling the first and second C-shaped side legs further includes:

engaging protrusions in the first C-shaped side leg with slits in the end legs of the second transformer portion;

engaging protrusions in the end legs of the second transformer portion with slits in the first C-shaped side leg;

engaging protrusions in the second C-shaped side leg with slits in the end legs of the third transformer portion; and engaging protrusions in the end legs of the third transformer portion with slits in the second C-shaped side leg.

11. A method of providing a portion of a transformer comprising:

forming a core of the transformer by:

providing transformer core material, cutting individual laminations from a single sheet of material, bending each individual lamination, one individual lamination at a time, into a generally C-shaped member, after the bending, stacking certain of the members to define a first core portion having a main leg and two opposing end legs, after the bending, stacking other of the members to define a second core portion having a main leg and two opposing end legs, arranging the main legs of the first and second core portions in a back-to-back manner to define the core having a core leg defined by the two main legs, and opposing core yokes, defined by the opposing end legs of the first and second core portions thereby eliminating a core annealing process in forming the core, and winding conductive material directly around the core leg to form a primary winding and secondary winding, thus providing a first transformer portion.

12. The method of claim 11, wherein the step of providing transformer core material provides a sheet of ferromagnetic metal.

13. The method of claim 11, wherein, prior to the step of winding the low voltage winding, the method includes clamping the main legs to be in contacting, back-to-back relation.

14. The method of claim 11, wherein during the step of winding the low voltage winding, cooling ducts are provided in the low voltage winding.

15. The method of claim 11, wherein during the step of winding the high voltage winding, cooling ducts are provided in the high voltage winding.

16. The method of claim 11, wherein the step of winding the conductive material to define the primary winding and the secondary winding includes winding the conductive material simultaneously with insulation material.

17. The method of claim 1, further comprising:

providing a pair of generally C-shaped side legs, coupling one side leg of the pair of C-shaped side legs to the end legs of the first core portion, and coupling the other side leg of the pair of C-shaped side legs to the end legs of the second core portion thereby defining a single phase transformer.

18. The method of claim 7, wherein the coupling steps further include engaging protrusions in the pair of C-shaped side legs with slits in the end legs of each of the first and second core portions, and engaging protrusions in the end legs of each of the first and second core portions with slits in the pair of C-shaped side legs.

* * * * *